US006155876A

United States Patent [19]

Ho et al.

[11] Patent Number: 6,155,876

[45] Date of Patent: Dec. 5, 2000

[54] CONNECTOR ADAPTER

[75] Inventors: Yu-Ming Ho, Pen-Chiao; Ming-Chun Lai, Shin-Juang, both of Taiwan

[73] Assignee: Hon Hai Precision Ind. Co., Ltd., Taipei Hsien, Taiwan

[21] Appl. No.: 09/221,195

[22] Filed: Dec. 23, 1998

[51] Int. Cl.[7] ..... H01R 13/648

[52] U.S. Cl. ..... 439/607

[58] Field of Search ..... 439/607, 79, 86, 439/541.5, 157–159, 325

[56] References Cited

U.S. PATENT DOCUMENTS

| | | | |
|---|---|---|---|
| 5,201,661 | 4/1993 | Li | 439/79 |
| 5,536,179 | 7/1996 | Olsson et al. | 439/108 |
| 5,688,130 | 11/1997 | Huang | 439/79 |
| 5,743,751 | 4/1998 | Davis et al. | 439/79 |

*Primary Examiner*—Paula Bradley
*Assistant Examiner*—Alexander Gilman

[57] ABSTRACT

A connector adapter for electrically receiving a card connector having a shielding, comprises an insulative body portion defining a mating face and a soldering face adjacent to the mating face. A plurality of contacts are received in passageways defined in the body portion between the mating and soldering faces. A concave surface is defined in a top face of the body portion opposite the soldering face and forms two hook devices upwardly extending therefrom symmetrical about a central line of the body portion. A metal cover forms an elastic tab on a central portion thereof and two holes symmetrical about the elastic tab for engaging with the hook devices thereby fixing the metal cover to the top face of the body portion. A reception space is defined between the metal cover and the concave surface for receiving the shielding of the card connector.

1 Claim, 6 Drawing Sheets

CONNECTOR ADAPTER

BACKGROUND OF THE INVENTION

1. Field of the Invention

The present invention relates to a connector adapter for interfacing between a card connector and a printed circuit board, and especially to a connector adapter used for electrically connecting a PCMCIA connector to a printed circuit board.

2. The Prior Art

PCMCIA card connectors have become popular in portable computers. Normally the connector has right angled tails directly soldered on a printed circuit board. However, some of the tails may be twisted during simultaneous insertion in corresponding pad holes of the printed circuit board due to the large number thereof. A spacer is further provided to isolate and position each contact tail to ensure correct insertion. However, the effect of the spacer is not satisfactory because it is laborious to fix the large dimensioned PCMCIA connector with a jig during soldering. Therefore, an adapter is provided which is soldered to the printed circuit board before the PCMCIA connector is inserted into the adapter without directly soldering the PCMCIA connector on the printed circuit board.

Referring to FIG. 1, a conventional adapter 50 is soldered on a printed circuit board 5 for receiving a PCMCIA connector 56 having a shielding 55. The adapter 50 has a body portion 51 engaged with a metal cover 52 between which a slot 59 is defined for receiving the shielding 55 of the PCMCIA connector 56. The metal cover 52 defines an opening 53 and an elastic tab 54 formed by stamping for engaging with the shielding 55 of the PCMCIA connector 56 when the latter is received in the slot 59. However, the metal cover 52 is apt to deform, as shown in FIG. 2, either during the stamping procedure or the configuring procedure for engaging with the body portion 51, thereby adversely affecting the engagement of the adapter 50 with the shielding 55 of the PCMCIA connector 56 and hindering the shielding effect of the overall configuration.

Hence, it is requisite to provide a new adapter structure which can provide a better shielding effect than the conventional one.

SUMMARY OF THE INVENTION

The primary purpose of the present invention is to provide an adapter which can be engaged with a PCMCIA connector with a good planarity and reliability thereby guaranteeing proper shielding effect of the overall configuration.

The second purpose of the present invention is to provide a new adapter which can be easily engaged with a PCMCIA connector by simple depression.

In accordance with one aspect of the present invention, a connector adapter for electrically receiving a card connector having a shielding comprises an insulative body portion defining a mating face and a soldering face adjacent to the mating face. A plurality of contacts are received in passageways defined in the body portion between the mating and soldering faces. A concave surface is defined in a top face of the body portion opposite the soldering face and forms two hook devices upwardly extending therefrom symmetrical about a central line of the body portion. A metal cover includes an elastic tab formed on a central portion thereof and defines two holes symmetrical about the elastic tab for engaging with the hook devices thereby fixing the metal cover to the top face of the body portion. A reception space is defined between the metal cover and the concave surface for receiving the shielding of the card connector.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Figure 1:
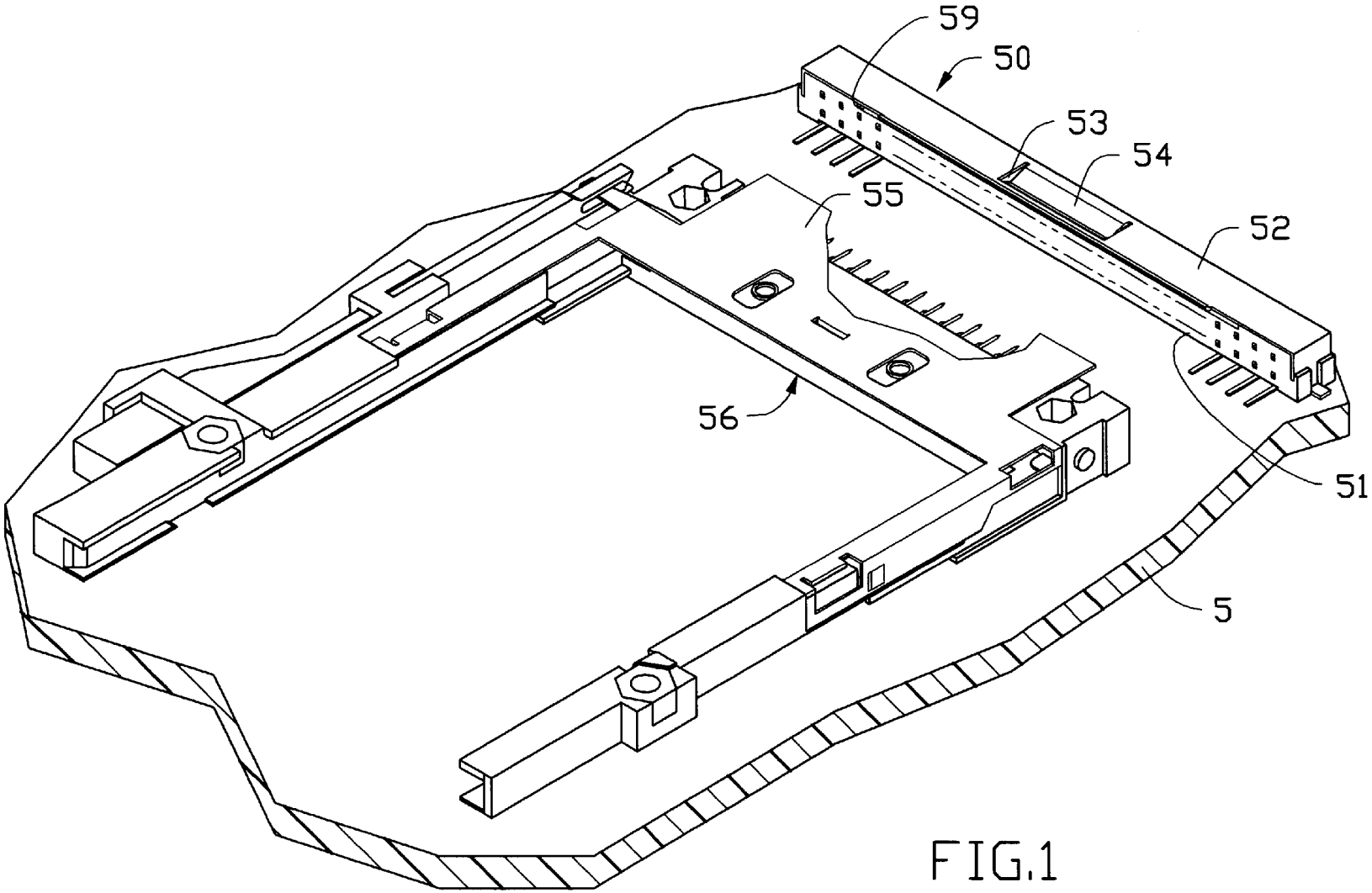
FIG.1 PRIOR ART
FIG. 1 is a perspective view of a conventional adapter fixed to a printed circuit board and a PCMCIA connector to be inserted therein.
Figure 2:
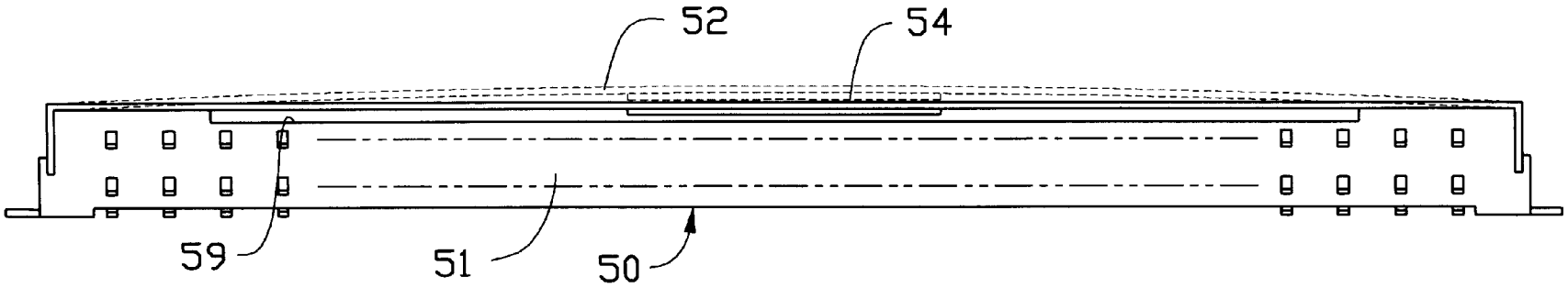
FIG.2 PRIOR ART
FIG. 2 is a front view of the conventional adapter of FIG. 1 showing deformation of a cover portion of the adapter.
Figure 3:
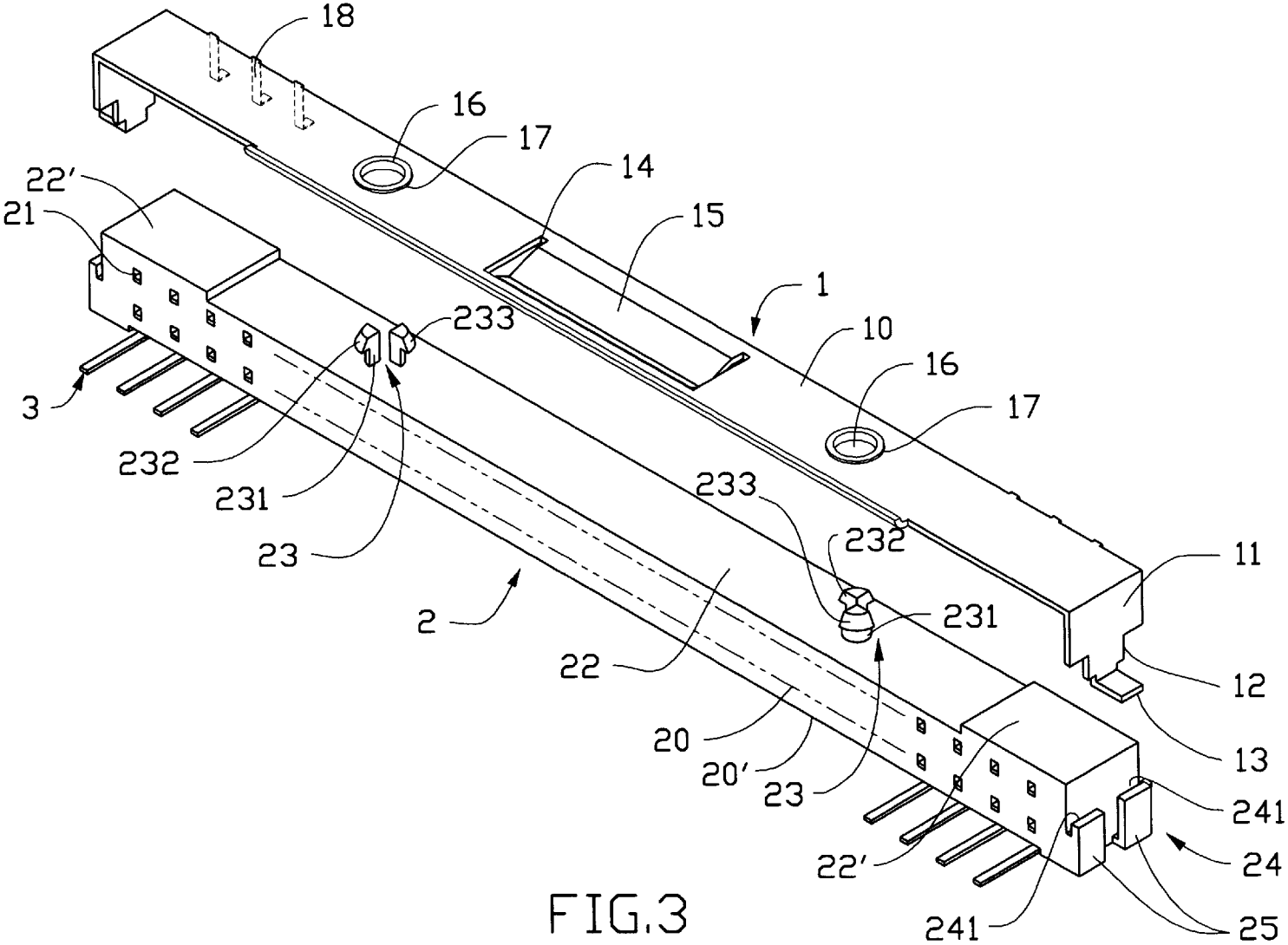
FIG. 3 is an exploded view of an adapter in accordance with the present invention.
Figure 4:
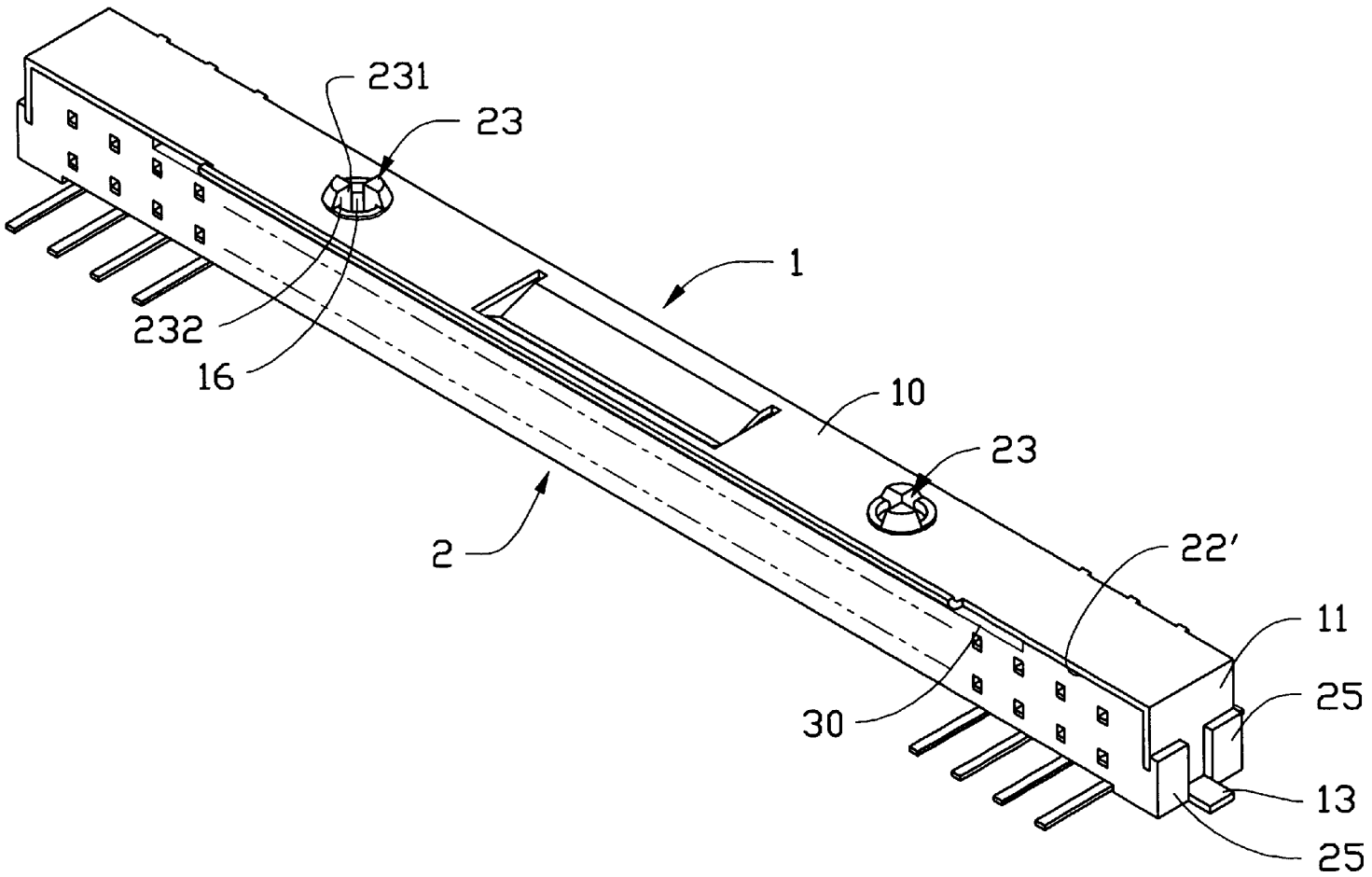
FIG. 4 is an assembled view of FIG. 3.
Figure 5:
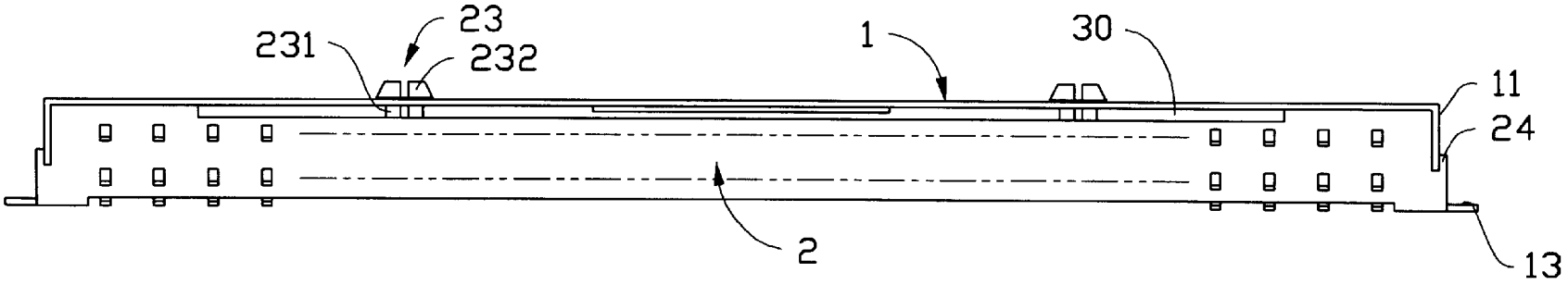
FIG. 5 is a front view of FIG. 4.

Referring to FIG. 3, an adapter for a PCMCIA card connector in accordance with the present invention comprises an elongate body portion 2 and a metal cover 1 engaged with the body portion 2. The body portion 2 comprises a mating surface 20 and a soldering surface 20' adjacent to the mating surface 20. A plurality of passageways 21 are defined between the mating surface 20 and the soldering surface 20' for receiving a corresponding plurality of contacts 3 therein. A concave surface 22 is defined in a middle portion of a top surface of the body portion 2 thereby forming two stand-offs 22' adjacent to the concave surface 22. Two sets of hook means 23 upwardly extend from the concave surface 22 substantially symmetrical about a center line of the concave surface 22. Each hook means 23 comprises two hooks 231 proximate each other. Each hook 231 has a tapered head 232 substantially extending laterally from a lengthwise direction of the hook 231. Specifically, each tapered head 232 is substantially a quarter of a circular disk wherein a tapered face 233 is formed between two horizontally parallel surfaces thereof. Two receptacles 24 are formed on opposite ends of the body portion 2. Each receptacle 24 comprises two halves each of which defines a slit 241 communicating with each other.

The metal cover 1 is substantially a U-shaped structure having a middle plate 10 and two engagement plates 11 extending downward from distal ends of the middle plate 10. Each engagement plate 11 has a lower narrower portion 12 which has a width sufficiently received in the slits 241. A tail portion 13 laterally extends from the lower narrower portion 12 and has a width less than a distance between the two halves 25 of the receptacle 24. An elongate opening 14 and an elastic tab 15 are formed by stamping the middle portion of the middle plate 10. Two holes 16 are defined in the middle plate 10 on opposite sides of the opening 14 and symmetrical about a central line of the opening 14. An embossment 17 is formed around each hole 16. A plurality of tails 18 extend downward from one side of the middle plate 10 for soldering to a printed circuit board 6 (FIG. 6).

Referring to FIGS. 3 through 6, the metal cover 1 is engaged with the body portion 2. The middle plate 10 is seated on the stand-offs 22' thereby defining a reception space 30 between the bottom surface of the middle plate 10 and the concave surface 22 for receiving a shielding 55 of a PCMCIA connector 56. During assembly, adjacent hooks 231 of each hook means 23 deflect toward each other when the head 232 forcibly extends through the hole 16. The head 232 then abuts against the embossment 17 after a lower surface of the middle plate 10 is seated on the stand-offs 22'. The tapered face 233 of each hook 231 facilitates the engagement of the hook 231 to the hole 16 when the metal cover 1 is mounted to the body portion 2. The metal cover 1 will not deform due to the engagement between the hook means 23 and the holes 16. When the metal cover 1 is engaged with the body portion 2, each tail portion 13 is moved downward along the space defined between the two halves 25 of the receptacle 24 until it contacts with the printed circuit board 6. Meanwhile, the lower narrower portion 12 of the engagement plate 11 is retained in the slits 241 of the receptacle 24.

Figure 6:
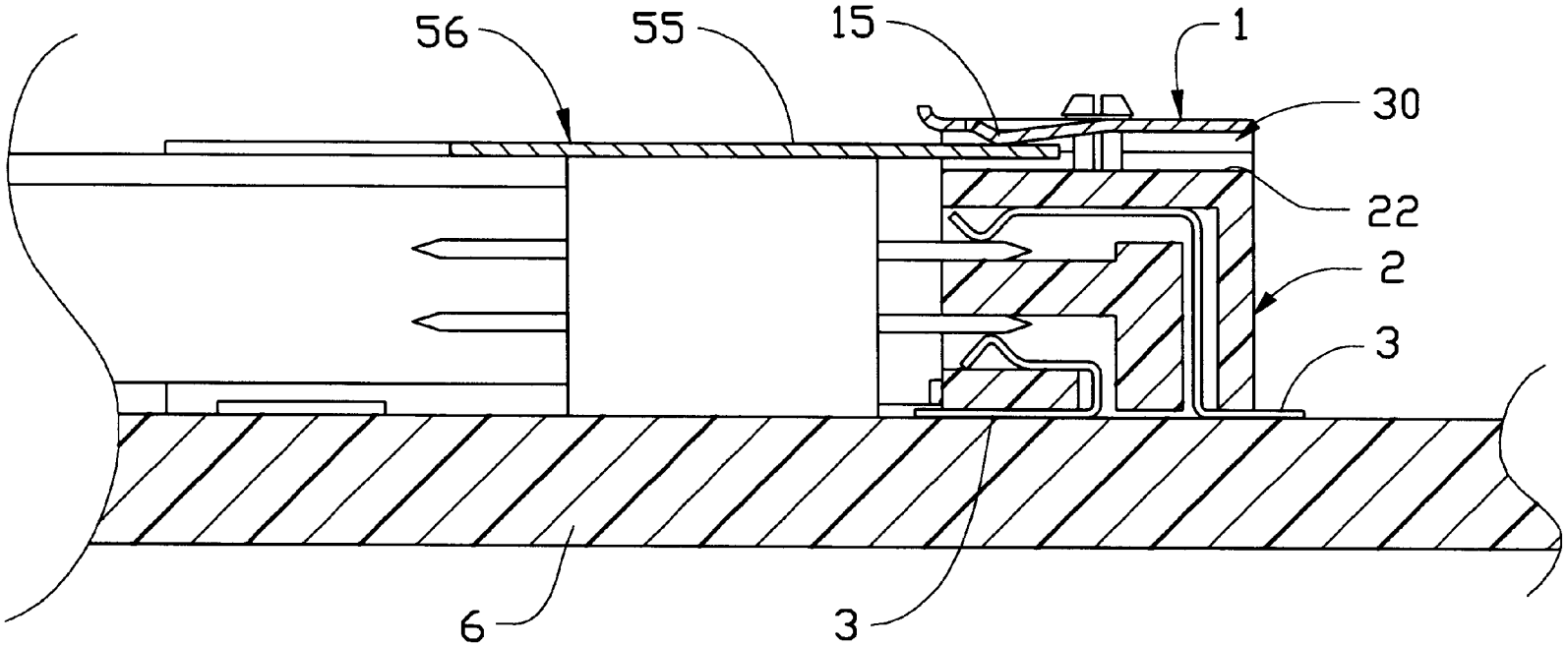
FIG. 6 is a cross sectional view showing engagement between the adapter and the PCMCIA connector.

Referring specifically to FIG. 6, the PCMCIA connector 56 is inserted into the adapter with the shielding 55 thereof snapping against a bottom portion of the elastic tab 15 of the metal cover 1.

From the above description, it can be concluded that the metal cover 1 of the adapter will not deform since the planarity thereof can be achieved by the engagement between the hook means 23 and the holes 16.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A connector adapter for electrically receiving a card connector having a shielding, comprising an insulative body portion defining a mating face and a soldering face adjacent to the mating face, a plurality of contacts received in passageways defined in the body portion between the mating face and the soldering face, a depressed surface defined in a top surface of the body portion opposite the soldering face and a metal cover, having an elastic tab formed in a central portion thereof, wherein a reception space is formed between the metal cover and the depressed surface of the body portion for receiving the shielding of the card connector, said hook means having a head engaging with a top face of the metal cover, wherein each set of the hook means comprises two hooks extending upward from the concave surface and proximate each other, wherein each hook has a tapered head extending laterally from a lengthwise axis thereof, said tapered head of each hook is substantially a quarter of a circular disk which includes a tapered face formed between two horizontally parallel surfaces thereof, wherein an embossment is formed around each hole for engaging with the tapered heads the hooks.

* * * * *